United States Patent [19]

Clouthier et al.

[11] Patent Number: 4,555,171

[45] Date of Patent: Nov. 26, 1985

[54] CONDUCTIVE CHARGE/DISCHARGE DEVICE

[75] Inventors: Richard S. Clouthier, Penfield; Thomas A. Rogers, Fairport, both of N.Y.

[73] Assignee: Schlegel Corporation, Rochester, N.Y.

[21] Appl. No.: 467,168

[22] Filed: Feb. 16, 1983

Related U.S. Application Data

[63] Continuation-in-part of Ser. No. 358,107, Mar. 15, 1982, abandoned.

[51] Int. Cl.[4] ..... G03G 15/02

[52] U.S. Cl. ..... 355/3 CH; 361/225; 361/230; 250/325

[58] Field of Search ..... 355/3 CH, 3 TR, 3 R; 250/224–226; 361/225, 230

[56] References Cited

U.S. PATENT DOCUMENTS

| | | | |
|---|---|---|---|
| 1,208,238 | 12/1916 | Tooker et al. . | |
| 2,774,921 | 12/1956 | Walkup | 355/3 CH |
| 3,611,052 | 10/1971 | Bishop et al. . | |
| 3,757,164 | 9/1973 | Binkowski | 355/3 CH |
| 3,776,631 | 12/1973 | Mammino | 355/3 R |
| 3,867,027 | 2/1975 | Weigl | 355/3 CH |
| 3,887,809 | 6/1975 | Marx et al. | 355/3 CH |
| 4,336,565 | 6/1982 | Murray et al. | 355/3 CH |
| 4,352,143 | 9/1982 | Uno . | |
| 4,361,922 | 12/1982 | Karal . | |
| 4,371,252 | 2/1983 | Uchida et al. | 355/3 CH |
| 4,383,752 | 5/1983 | Kisler | 361/225 X |
| 4,402,599 | 9/1983 | Seto | 355/15 X |
| 4,449,808 | 5/1984 | Abreu | 355/3 CH |

*Primary Examiner*—R. L. Moses

*Attorney, Agent, or Firm*—Cushman, Darby & Cushman

[57] ABSTRACT

A copying or printing apparatus has a photoconductive surface, a charging station to impart an electrostatic charge to at least a portion of the photoconductive surface, an exposure station, a development station and a transfer station followed by a discharge station, at the charging station a charging device in the form of a support surface having a plurality of conductive fibers extending therefrom to a substantially uniform height toward the photoconductive surface is provided and which has a conductor connected to a potential voltage source.

22 Claims, 5 Drawing Figures

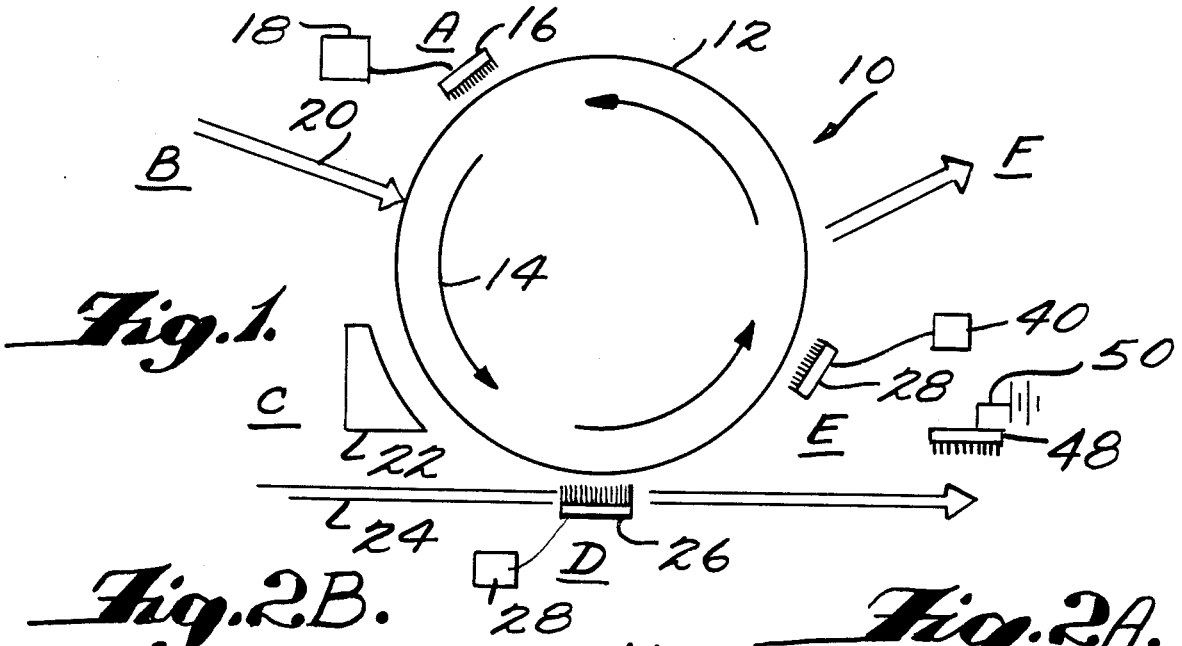
Fig. 1.
Fig. 2B.
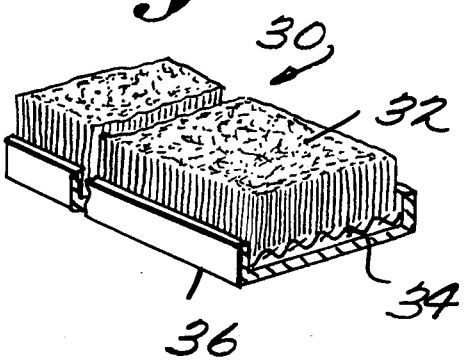
Fig. 2A.
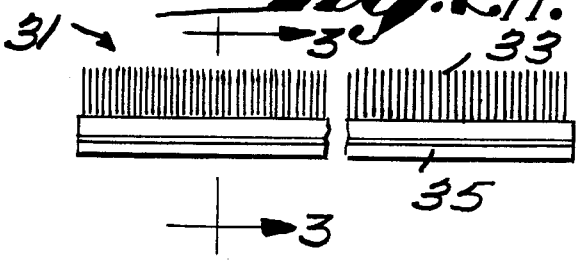
Fig. 3.
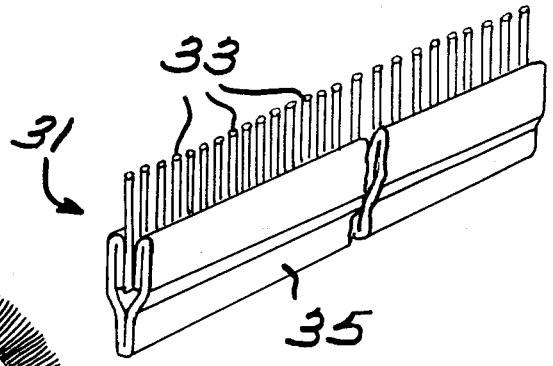
Fig. 4.
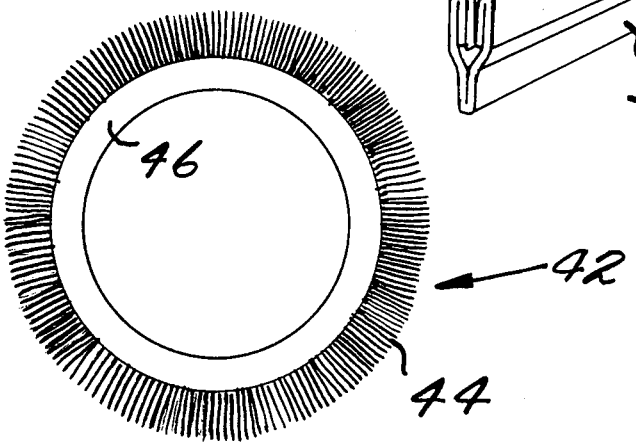

CONDUCTIVE CHARGE/DISCHARGE DEVICE

This application is a continuation-in-part of application, Ser. No. 358,107, filed Mar. 15, 1982, now abandoned.

BACKGROUND AND BRIEF SUMMARY OF THE INVENTION

The present invention relates to improvements in electrostatic, xerographic and other types of electrophotographic copiers printers and, in particular, provides, as a substitute for the conventional wire, grid or mesh corona charging and discharging devices, a pile fabric brush device which will provide substantial charge uniformity in the charging and charge dissipating stations of such a copier printers and yet will perform at substantially lower voltages than has heretofore been the case without contacting the photoconductive surface. A second advantage is that the resultant distributed electrostatic charge is of a more uniform nature than the charge which is placed by current devices.

The essentials of the xerographic process are taught in U.S. Pat. No. 2,297,691, to C. F. Carlson. In general, the process involves the steps of placing a uniform electrostatic charge on a photoconductive insulating surface, exposing the surface to visible light and a shadow image to dissipate the charge selectively on the areas of the surface exposed to the light and then developing the resulting electrostatic latent image by the deposition on the surface of a developing material such as a refined electroscopic powder material. The particles of the powder will normally be attracted to the areas on the surface which retain an electrostatic charge to thereby form an image corresponding to the electrostatic latent image. Subsequently, the powder image is transferred to a receiving member such as a sheet of paper where the image is fixed as by fusing.

Essential to the success of the electrostatic copying process is the imposition of a uniform electrostatic charge on the photoconductive surface. To this end, the prior art has, in general, utilized corona charging devices in the form of one or more wires suspended across the photoconductive surface and which are connected to a potential voltage source to provide a potential difference of several thousand volts to efficiently create a net charge on the photoconductive surface. However, as recognized in U.S. Pat. No. 4,197,331, these devices are expensive, complex and potentially hazardous in view of the high potential power supplies required and the high concentration of ozone generated which will support spontaneous combustion or corrode other equipment parts in close proximity. For example, in order to charge a photoconductive surface to a potential of several hundred volts, it is necessary to impose a voltage difference between the photoconductive surface and the corona discharge device of several thousand volts in order to achieve a satisfactory uniformity of charge on the photoconductive surface.

Similarly, in high speed electrostatic copiers printers where the photoconductive surface is moved past a plurality of stations for immediate re-use, it is necessary to discharge the photoconductive surface and, again, it has been conventional to use wire type corona discharging devices connected to a potential source of different polarity to render the photoconductive surface ready for re-charging for subsequent copies and for facilitating cleaning of any residual toner from the photoconductive surface.

Also, with the use of such high potential voltages, the creation of ozone gas is inevitable and which is undesirable since this gas is highly corrosive.

Prior patents repesentative of the art in this field include: Nos. 2,790,082, 2,885,556, 2,952,241, 2,965,481, 2,968,552, 3,146,688, 3,223,548, 3,244,083, 3,332,396, 3,471,695, 3,866,572, 3,997,688, 4,122,210 and 4,164,372.

Of particular interest in U.S. Pat. No. 3,146,385 to Carlson, which discloses a contact charging apparatus for use in xerography which differs from the present invention in that the wires contact the photoconductive surface, on the one hand, and, on the other, in each embodiment, the wires are insulated from each other unlike the pile fabric of the present invention.

In U.S. Pat. No. 2,774,921, to Walkup, there is disclosed a charging device for a photoconductive surface where, in one embodiment, a pliable element is provided with bristles which are maintained in contact with the photoconductive surface. The pliable element is connected to a potential source that is described as lower than that usually used with conventional corona discharge devices. In another embodiment, the pliable element is used to charge the photoconductive surface without the bristles, and in this arrangement, the pliable element can be flexed against the photoconductive surface or spaced above and out of contact with this surface. Satisfactory operation was said to be obtained with this device where the elements have a resistance of between 10,000 ohms to about 100 megohms. Thus, highly conductive elements such as copper, silver and other common metals are disclosed as being unsuitable for the charging element.

The present invention provides a non-contact charging and discharging device for a copying apparatus which includes a brush-like structure of densely packed fibers of substantially uniform height where the fibers themselves are highly conductive, have minimal resistance and are each connected to a conductive base which in turn is connected to a potential voltage source of desired polarity or to ground. In one embodiment, the device can be used to charge a photoconductive surface at a charging station in an electrostatic copier printer and, in another embodiment, at a discharging station to dissipate electric charge and as a device for charging a sheet or photoreceptor which is to receive the copy to improve adherence of the developing powder to a latent image before and between the transfer station and fusing station of the apparatus. With this arrangement, much lower potential voltages can be employed while achieving substantially more uniform charge distribution and dissipation on the photoconductive surface because all the current used is useful in that it goes toward applying the desired charge to the photoreceptor surface. The current is not lost to a grounded shield or other screening device as found on current charging devices.

The foregoing and other advantages will become apparent as consideration is given to the following detailed description taken in conjunction with the accompanying drawings, in which:

BRIEF DESCRIPTION OF THE DRAWINGS

FIG. 1 is a schematic illustration of an electrostatic copying apparatus;

FIG. 2A is a view in elevation of one embodiment;

FIG. 2B is a perspective view of another embodiment of the charge distribution device of the present invention;

FIG. 3 is a view taken along lines 3—3 of FIG. 2A; and

FIG. 4 is an end view of another embodiment of the charging device of the present invention.

DETAILED DESCRIPTION OF THE INVENTION

Referring to the drawings wherein like numerals designate corresponding parts throughout the several views, there is shown in FIG. 1 in side elevation a schematic illustration of the conventional electrostatic copying apparatus generally designated at 10. In the illustrated apparatus, a rotary drum 12 is employed but it will be understood by those skilled in the art that other well known transport devices may be utilized such as belts, conveyors, ribbons or masters to move a photoconductive surface through the various work stations of the apparatus. With a rotary drum 12, as is well known, the surface thereof is provided with a photoconductive surface which, in a conventional arrangement, overlies a conductive surface or layer of the drum 12. The drum 12 is mounted for rotation in the direction of the arrows 14 so that a portion of the surface of the photoconductive layer on the drum 12 will be moved cyclically from station to station.

In the well known xerographic process, a portion of the photoconductive surface is first exposed to a corona discharge as at Station A to uniformly charge the photoconductive surface to a suitable potential. To this end, the apparatus 10 will include a charging device 16 which is connected to a potential voltage source schematically illustrated at 18. After a portion of the surface 12 is suitably charged, that portion is then exposed to an image of an original to be copied as at Station B with the exposure indicated schematically by the arrow 20. The exposure to light at Station B changes the charge distribution imparted to the photoconductive surface 12 at Station A due to the nature of the photoconductive layer. A number of different materials can be employed for the photoconductive surface such as vitreous selenium or other selenium alloys, cadmium sulfide, zinc oxide, aluminum oxide, amorphous silicon hydride organic compounds, as well as other well known materials. The resultant electrostatic image is then developed at Station C such as by coating the surface with a development powder by a device 22. Of course, other development means are well known in this art and may be employed in the alternative. From Station C the coated portion of the photoconductive layer is moved to Station D where a transport mechanism schematically illustrated by the arrow 24 functions to move a support medium such as a sheet of paper into engagement with the surface of the drum 12. A charging device 26 is usefully employed to charge the sheet of paper, mylar, card stock, transparencies, plastic to improve retention of the transferred image by electrostatic attraction of the powder particles to the sheet. Thereafter, the transport mechanism 24 separates the sheet from the drum and moves the sheet to a fusion device which permanently adheres the image to the sheet. As the drum 12 rotates, it passes in proximity to a discharge Station E where a discharge device 28 is energized to dissipate any remaining charges on the photoconductive surface to facilitate cleaning of the surface at Station F. At Station F any of the well-known cleaning devices such as cleaning blade, magnetic brush the cleaning brush disclosed in U.S. application Ser. No. 222,878, filed Jan. 6, 1981, may be employed to render the photoconductive surface ready for the next copying cycle.

It has been recognized that one of the limitations on the speed and efficiency with which the copying device such as illustrated at 10 in FIG. 1 can be operated is the attainment of a uniform distribution of charge on the photoconductive surface on drum 12 at Station A by the charging device 16. In order to increase the speed of rotation of the drum 12, other things being equal, it was necessary to maintain the potential of the charging device 16 at several thousand volts and any increase in speed required a corresponding increase in this potential difference. As a result, the hazards of operating such machines have required the incorporation of expensive safety devices and shields, on the one hand, and on the other hand, these high potentials have resulted in the creation of ozone gas which is detrimental to the other elements of the copying device due to the highly corrosive nature of this gas.

The present invention overcomes these drawbacks by incorporating as a charging device a low density filament structure as illustrated in FIG. 2A by the numeral 31. The filament brush 31 may, for example, consist of filaments having a diameter of approximately 0.001 inches and which are conductive fibers such as stainless steel, copper, silver, gold, carbon, nickel, aluminum or any conductive coated manmade fiber such as rayon, nylon, dacron, Teflon or a blend thereof, which are made conductive by coating with a conductive material such as one of those mentioned above. According to the present invention, it has been found that the fiber density of the brush has a significant impact on the uniformity of the charging and discharging function. While the other parameters such as fiber length and thickness are important, a fiber density of between approximately 6 and 84 filaments per lineal inch was found to give substantially more uniform charge distribution than a two-wire corona device while a fiber density of between 904 and 247,500 filaments per square inch was found to be satisfactory for a passive discharge application. In the brush of FIG. 2A, the individual fibers 33 are preferably evenly spaced along the length of the conductive support member 35.

In a passive discharge operation, the brush of FIG. 2B is used where the conductive pile fabric 32 is fabricated with a support backing 34 which has its surface from which the individual fibers extend coated with a conductive coating material such as a silver, nickel, copper, carbon or stainless steel filled epoxy adhesive. In turn, the support backing is secured to a support bracket 36 of metal or conductive plastic to facilitate positioning the fibers relative to the surface of the drum 12. The support bracket 36 is shown partially broken away in FIG. 2B while, in practice, the bracket 36 extends the length of the brush.

The fibers should all be of substantially uniform height relative to the support backing 34 and the brush 30 will be of sufficient length to traverse the width of the photoconductive surface on the drum 12. As an example, a fiber length of between 0.375 to 1 inch can be used and a length between about 0.375 to 0.750 has been satisfactory. The width of the brush 30 as measured in the direction of rotation of the drum 12 will to a large extent depend upon the dimensions of the drum 12 and can easily be determined by trial and error testing. As an example, a width of the charging device of ⅛ to 3 inches should suffice for most applications.

The filament 31 of FIG. 2A is usually employed as the charging device 26 at transfer Station D. With the support bracket 35 made of a conductive metal or plastic, the brushes 30 and 31 at each of the Stations A, D and E are easily connected to separate sources of potential voltages such as at 18, 38 and 40. Of course, as will be obvious to those skilled in this art, a single potential source may be connected in seriatim through appropriate switches to each of the brushes at each work Station A, D and E where the source can be switched between positive, neutral and negative potentials.

In a preferred embodiment, the fibers 32 of the brushes 30 and 31 may be made of a very fine stainless steel fiber that has a cross-sectional dimension in the range of 4–25 microns while 12–15 microns has been satisfactorily employed.

The brush 30 may also be manufactured in the form of a roller brush such as illustrated at 42 in FIG. 4. The brush 42 consists of a pile fabric 44 which is manufactured in the form of a tube having a conductive backing in the form of a copper, stainless steel or the like sleeve which, in turn, is mounted on a conductive core 46 of similar material. A suitable insulation mounting can be provided to rotatably mount the brush 42 adjacent an appropriate work station in a photocopying machine whereby the core 46 is connected to a potential voltage source to uniformly charge the individual fibers of the fabric 44.

In addition to the conductive filaments mentioned above, the fibers of the brush may be made of aluminum, carbon filaments or may be synthetic fibers coated with a precious metal such as silver or gold, or carbon coated. In addition, natural fibers which are suitably coated with a conductive material as mentioned above may also be employed. In addition, the pile fabric of brush 30 may be constructed by weaving, knitting, sliver knitting or tufting a conductive backing provided the resultant pile has the distribution of filaments as noted above.

With the proper density of the fiber ends, each fiber tip acts as an individual corotron thereby placing a more uniform charge on the photoconductive surface or removing charge, depending on the specific function.

By way of example, it has been found that with a brush manufactured according to the embodiment of FIG. 2A, a uniform charge can be placed on a photoconductive surface with an applied voltage of 5,000 volts where the filament ends are spaced from the photoconductive surface at about 0.250 inches and a current of 50 microamps. With a conventional corona discharge device, a voltage of 5,000 volts achieved unsatisfactory results. In placing a charge on the brush 30, it has been noted that the fiber tips separate from one another rendering the overall brush width wider than without a charge which is believed to result in a more uniform charge on the photoconductive surface without the fiber tips actually contacting the photoconductive surface. Also, since ozone generation is directly proportional to corona emission, with the brush of the present invention, approximately two-thirds less ozone is generated.

A comparison test was conducted using the fiber brush 30 of the present invention and a two-wire corona charging device which incorporated a conductive shield. In the first test, a stainless steel fiber brush like the one shown in FIG. 2A having a 0.375 inch pile height and with the fibers having a cross-sectional dimension of approximately 15 microns with 488 filaments per linear inch of the brush was used. With the fiber tips spaced 0.25 inches from a metal plate, the following currents were measured on the plate at the stated negative D.C. voltages applied to the fibers:

−4,000 volts; 50 microamps;
−5,000 volts; 150 microamps;
−6,000 volts; 275 microamps;
−7,000 volts; 440 microamps;

Where the spacing was increased to 0.500 inches and 0.7500 inches at the same voltages, substantially lower currents were measured as would be expected.

When a conventional shielded two-wire corona device was also employed and the current measured on a barefaced metal plate and at the same spacing of 0.250 inches and −7,000 volts applied, the imposed current was only 150 microamps. To obtain approximately 400 microamps imposed current, the corona device had to be moved to nearly 0.125 inches which at a voltage of −7,000 is an undesirable electrical arrangement. It should be noted that the mounting distance with the corona discharge device was measured from the edge of the shield since the shield is a necessary structure in using a wire corona device since the efficiency of the wire corona device is drastically affected where the shield is omitted.

Comparable tests with brushes with pile densities of 244 to 14,850 filaments per square inch each gave satisfactory test results and all performed better than the conventional two-wire corona discharge device even where positive D.C. voltages were applied although the imposed currents were measured to be lower for both types of devices.

The brush 30 of the present invention is particularly useful to discharge static electric buildup on the material on which the copy image is imposed such as by placing a brush 48 downstream of the brush 26 with the brush 48 being connected to an appropriate potential source 50 so as to neutralize any charge on the sheets that are passed in close proximity to the tips of the fibers of brush 48.

The brush 31 is, on the other hand, particularly useful in placing charge on a conductive surface and charge uniformity is enhanced using a negative potential.

Having described the invention, it will be apparent to those skilled in the art that various modifications may be made thereto without departing from the spirit and scope of the present invention as defined in the appended claims.

What is claimed is:

1. In a copying apparatus of the type having a photoconductive surface, a charging station to impart an electrostatic charge distribution to at least a portion of said photoconductive surface, an exposure station to impose an image on said portion of said surface, to thereby influence the charge distribution, a development station at which a developing material is deposited on said portion of said surface in a pattern corresponding to the image to be reproduced, a transfer station having means for transferring the pattern to a sheet means and a discharge station for dissipating electrostatic charge on said portion of said surface, said photoconductive surface and said stations being relatively movable whereby a portion of said photoconductive surface is locatable adjacent a selected station, the improvement comprising said charging station including a charging device comprising an elongated, linear distribution of conductive fibers mounted on a conductive support means and extending across said charging station, with from 6 to 84 fibers per lineal inch and means connecting said fibers to a potential voltage source, said discharge station including a discharging means including an annular core having an exterior cylindrical surface which is covered with a plurality of closely positioned conductive fibers extending generally radially therefrom, means mounting said core of said discharging station for rotation adjacent to but with said fibers spaced from a said portion of said photoconductive surface at said discharge station and means connecting said fibers to a potential voltage source with a polarity different from that of said potential voltage source of said charging means.

2. The apparatus as claimed in claim 1 wherein said transfer station includes means for charging said sheet means, said sheet means charging means including a charging device comprising an elongated, linear distribution of conductive fibers mounted on a conductive support means and extending across said charging station, with from 6 to 84 fibers per lineal inch and means connecting said fibers of said sheet means charging means to a potential voltage source.

3. The apparatus as claimed in claim 1 wherein said plurality of closely positioned conductive fibers is in the form of a pile fabric having a fabric base from which said fibers extend, said fabric base being in the form of a sleeve having an interior surface opposite the surface from which said fibers extend which is coated with a conductive coating.

4. The apparatus as claimed in claim 1 wherein said pile fabric is a woven fabric.

5. The apparatus as claimed in claim 1 wherein said pile fabric is a knitted fabric.

6. The apparatus as claimed in claim 1 wherein said pile fabric is a tufted fabric.

7. The apparatus as claimed in claim 1 wherein said fibers are a conductive metal.

8. The apparatus as claimed in claim 7 wherein said fibers are copper filaments.

9. The apparatus as claimed in claim 7 wherein said fibers are stainless steel filaments.

10. The apparatus as claimed in claim 7 wherein said conductive fibers are aluminum filaments.

11. The apparatus as claimed in claim 7 wherein said conductive fibers are carbon filaments.

12. The apparatus as claimed in claim 7 wherein said conductive fibers are silver-coated synthetic fibers.

13. The apparatus as claimed in claim 7 wherein said conductive fibers are carbon-coated synthetic fibers.

14. The apparatus as claimed in claim 7 wherein said conductive fibers are natural fibers coated with a conductive metal.

15. The apparatus as claimed in claim 1 wherein said conductive fibers are a conductive metal.

16. The apparatus as claimed in claim 15 wherein said fibers are copper filaments.

17. The apparatus as claimed in claim 15 wherein said fibers are stainless steel filaments.

18. The apparatus as claimed in claim 15 wherein said conductive fibers are aluminum filaments.

19. The apparatus as claimed in claim 15 wherein said conductive fibers are carbon filaments.

20. The apparatus as claimed in claim 15 wherein said conductive fibers are silver-coated synthetic fibers.

21. The apparatus as claimed in claim 15 wherein said conductive fibers are carbon-coated synthetic fibers.

22. The apparatus as claimed in claim 15 wherein said conductive fibers are natural fibers coated with a conductive metal.

* * * * *